US011591119B2

(12) United States Patent
Arbulu Ormaechea et al.

(10) Patent No.: US 11,591,119 B2
(45) Date of Patent: Feb. 28, 2023

(54) PRODUCT PACKAGING METHOD AND MACHINE

(71) Applicant: ULMA Packaging, S. Coop., Oñati (ES)

(72) Inventors: Nerea Arbulu Ormaechea, Oñati (ES); Nicolas Arregi Arambarri, Oñati (ES)

(73) Assignee: ULMA PACKAGING, S. COOP., Oñati (ES)

( * ) Notice: Subject to any disclaimer, the term of this patent is extended or adjusted under 35 U.S.C. 154(b) by 0 days.

(21) Appl. No.: 17/220,391

(22) Filed: Apr. 1, 2021

(65) Prior Publication Data

US 2021/0316891 A1 Oct. 14, 2021

(30) Foreign Application Priority Data

Apr. 8, 2020 (EP) ..... 20382285

(51) Int. Cl.

| | |
|---|---|
| ***B65B 9/02*** | (2006.01) |
| ***B65B 31/04*** | (2006.01) |
| ***B65B 41/14*** | (2006.01) |
| ***B65B 25/00*** | (2006.01) |
| ***B65B 47/08*** | (2006.01) |

(Continued)

(52) U.S. Cl.

CPC ..... *B65B 9/02* (2013.01); *B65B 11/52* (2013.01); *B65B 25/001* (2013.01); *B65B 31/04* (2013.01); *B65B 41/14* (2013.01); *B65B 47/08* (2013.01); *B65B 53/02* (2013.01); *B65B 61/06* (2013.01)

(58) Field of Classification Search

CPC .. B65B 11/52; B65B 9/02; B65B 9/04; B65B 9/045; B65B 25/001; B65B 47/08; B65B 47/10; B65B 53/02; B65B 61/06; B65B 41/14

See application file for complete search history.

(56) References Cited

U.S. PATENT DOCUMENTS 3,634,993 A * 1/1972 Pasco ..... B65B 11/52 53/511
3,895,475 A * 7/1975 Wolfelsperger ..... B65B 31/021 53/433

(Continued)

FOREIGN PATENT DOCUMENTS

DE 3430249 A1 3/1985
WO 9801363 A1 1/1998

(Continued)

OTHER PUBLICATIONS

Extended European Search report received in EP application No. 20382285.3, dated Aug. 27, 2020 (8 pages).

*Primary Examiner* — Joshua G Kotis

(74) *Attorney, Agent, or Firm* — Edell, Shapiro & Finnan, LLC

(57) ABSTRACT

According to one embodiment a packaging machine and method for packaging a product is provided in which a cover film is arranged on the product and on a base film which supports the product and is narrower than the cover film; the superimposed films are moved in a first direction to a joining station where both films are attached to one another; and the attached films are moved in the first direction to a cutting station where the films are cut transversely and where the areas of the cover film projecting from the base film are cut longitudinally. The movement of the films is caused by acting on the cover film.

10 Claims, 3 Drawing Sheets

(51) Int. Cl.

| | |
|---|---|
| ***B65B 61/06*** | (2006.01) |
| ***B65B 11/52*** | (2006.01) |
| ***B65B 53/02*** | (2006.01) |

(56) References Cited

U.S. PATENT DOCUMENTS

| | | | | |
|---|---|---|---|---|
| 2002/0063070 | A1* | 5/2002 | Stockley, III | B65B 31/025 206/213.1 |
| 2002/0119073 | A1* | 8/2002 | McGowan, Jr. | A61L 2/04 422/26 |
| 2003/0196412 | A1* | 10/2003 | Foulke, Jr. | B65B 11/52 53/329.3 |
| 2005/0173289 | A1* | 8/2005 | Natterer | B65B 31/021 206/524.8 |
| 2006/0048480 | A1 | 3/2006 | Konishi | |
| 2008/0104930 | A1* | 5/2008 | Sparakowski | B65B 31/06 53/510 |
| 2014/0158502 | A1* | 6/2014 | Kurz | B65B 9/04 198/850 |
| 2015/0191267 | A1* | 7/2015 | Mochizuki | B65B 9/04 53/373.2 |
| 2016/0130024 | A1* | 5/2016 | Paul | B65B 31/028 53/79 |
| 2016/0159507 | A1* | 6/2016 | Izquierdo Ereno | B65B 9/045 53/553 |
| 2016/0194101 | A1* | 7/2016 | Palumbo | B65B 61/005 53/511 |

FOREIGN PATENT DOCUMENTS

| | | | |
|---|---|---|---|
| WO | 2014056806 | A1 | 4/2014 |
| WO | 2014180823 | A1 | 11/2014 |

* cited by examiner

PRODUCT PACKAGING METHOD AND MACHINE

CROSS-REFERENCE TO RELATED APPLICATIONS

This application relates to and claims the benefit and priority to European Application No. EP20382285.3, filed Apr. 8, 2020.

TECHNICAL FIELD

The present invention relates to packaging machines and methods, preferably thermoforming machines which generate modified atmosphere, vacuum or skin packages, and methods suitable for being implemented in said machines.

BACKGROUND

There are different methods for increasing the shelf-life of packaged food products, such as for example, vacuum packaging, skin packaging (which requires causing a vacuum inside the package and heating the film so that the film can subsequently adapt to the shape of the product and be sealed to the base) or packaging with modified atmosphere (where a gas is injected to increase product shelf-life). All these methods require accessing the inside of the package before package generation is completed in order to perform the necessary actions (gas extraction and/or injection).

In some cases, the packages are generated from a base film on which there are placed the product to be packaged and a cover film covering the product and the base film. Both films are attached to one another with the product therein in a joining station, and the excess material is then cut and removed from the films.

To enable accessing the space between both films and thereby accessing the volume where the product is contained, at least one hole is made on one of the films, usually the base film, in the joining station. An example is shown in document US20080104930A1 which shows a joining station with a cutting implement suitable for making said hole (or holes) in the base film. This entails the need to discard at least the part of the perforated base film that cannot be part of the end package, which in turn entails the need to treat said discarded material so that it does not negatively affect the end package (so that it is not packaged along with the product, for example).

Document US20050173289A1 shows a packaging machine, and not only the joining station like in the preceding case, particularly a method in which the films are shrunk once a vacuum package is generated. This document does not disclose how the inside of the package is accessed to generate the vacuum, which can be performed in a manner similar to that described for document US20080104930A1, for example (a hole in the base film), said hole being made on a part of said base film which is or not part of the end package.

WO2014180823A1 discloses an apparatus and process for packaging a product, wherein once a cover film is sealed to a base film both films are moved acting on only the cover film.

SUMMARY

A first aspect of the invention relates to a method for modified atmosphere, vacuum or skin packaging of products in a thermoforming machine. To generate a package, the method comprises:

a first forward movement step in which a cover film is arranged on a product to be packaged and on a base film which supports said product, in a superposing area of the machine, and in which both films are moved in a first direction to a joining station of the machine which is arranged downstream of the superposing area in the first direction;

an attachment step in which both films are attached to one another with the product housed between them, the cooperation between a lower tool and an upper tool of the joining station being caused to that end, with a cavity for housing the product being demarcated between both tools through said cooperation and the contour of said cavity being demarcated by two longitudinal walls and two transverse walls;

a second forward movement step in which the films attached in the joining station are moved in the first direction to a cutting station of the machine arranged downstream of the joining station in the first direction; and a cutting step in which at least one transverse cut is made in the films in a second direction which is transverse to the first direction, obtaining an individual package with the product therein.

The cover film which is arranged on the base film in the first forward movement step comprises a width greater than the width of the base film in the second direction, said films being arranged with respect to one another in the superposing area such that two areas of the cover film project transversely from respective longitudinal edges of the base film in said second direction.

In the first forward movement step and in the second forward movement step, a transport device only acts on the two areas of the cover film projecting transversely from the base film (therefore without acting on or contacting the base film) to cause the forward movement of both films in the first direction, and at least between the joining station and the cutting station.

In the attachment step, the tools of the joining station cooperate with one another to attach the base film and the cover film to one another such that they longitudinally grip said cover film but not said base film, and gas between said films is injected and/or extracted through at least one of the respective access spaces that is available between each longitudinal edge of the cover film and the longitudinal wall demarcating the cavity closer to said longitudinal edge. In the cutting step, a longitudinal cut is made on the areas of the cover film projecting transversely from the base film.

Therefore, no action is performed on the base film in order to generate a package given that both the attachment thereof to the cover film and the movement thereof in the first direction are performed with actuations that are only performed on the cover film alone. This prevents the need to discard the material of the base film, where the necessary and right amount can be used for generating the required packages, with the savings in material that this entails. That is particularly advantages for those packages in which the base film can be made of cardboard, for example, as it provides robustness to the package (due to the material of the base film) while at the same time reducing the amount of that material necessary for each package. Additionally, the use of less material and attainment of packages in a more cost-effective manner prevent the discarding of the base film that is attached to the cover film which can barely be recycled, achieving an environmentally friendly method.

A second aspect of the invention relates to a product packaging machine, comprising a first film feeding device which is configured for supplying a base film;

a second film feeding device configured for supplying a cover film;

a transport device which is configured for moving the films in a first direction;

a superposing area;

a joining station which is downstream of the superposing area in the first direction and comprises a lower tool and an upper tool which are configured for cooperating with one another to attach both films to one another and demarcate a cavity with said cooperation, for housing the product and the films between both tools, the contour of said cavity being demarcated at least by two longitudinal walls in the first direction and two transverse walls and said cavity comprising a specific width in a second direction which is transverse to the first direction;

actuation means in the joining station which are configured for injecting and/or extracting gas between said films when the tools of said joining station cooperate with one another; and a cutting station which is arranged downstream of the joining station in the first direction and configured for cutting the films and for generating individual packages with said cut.

The transport device is configured for acting only on the cover film and at least between the joining station and the cutting station, for moving the films in the first direction with said actuation. The tools of the joining station are configured for cooperating with one another such that, together, they longitudinally grip said cover film but not said base film, the joining station further comprising actuation means which are configured for injecting and/or extracting gas between said films, and the cutting station comprises at least one longitudinal cutting element suitable for longitudinally cutting only the cover film.

The advantages mentioned for the first aspect of the invention are also obtained with the second aspect of the invention.

These and other advantages and features of the invention will become evident in view of the drawings and detailed description of the invention.

DETAILED DESCRIPTION

Figure 1:
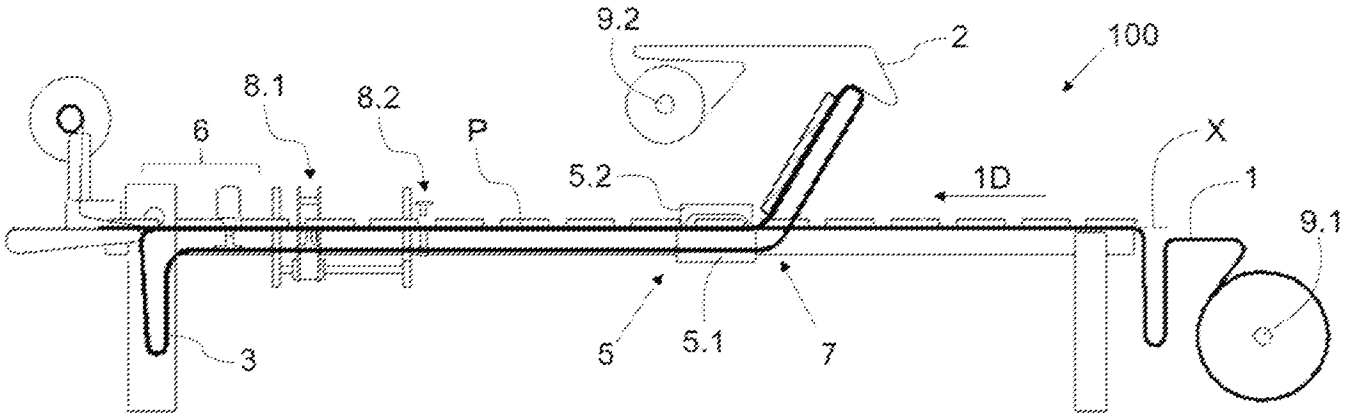
FIG. 1 schematically depicts a thermoforming machine according to one embodiment.

A first aspect of the invention relates to a method for packaging food products in a thermoforming machine 100 like the one shown by way of example in FIG. 1. To generate a package, the method comprises at least a first forward movement step, an attachment step, a second forward movement step, and a cutting step, in that order.

In the first forward movement step, a cover film 2 is arranged on a product P to be packaged and on a base film 1 which supports said product P, in a superposing area 7 of the machine 100, and both films 1 and 2 are moved in a first direction 1D to a joining station 5 of the machine 100 which is arranged downstream of the superposing area 7 in the first direction 1D. The method comprises a feeding step in which the product P to be packaged is arranged on the base film 1.

Figure 2:
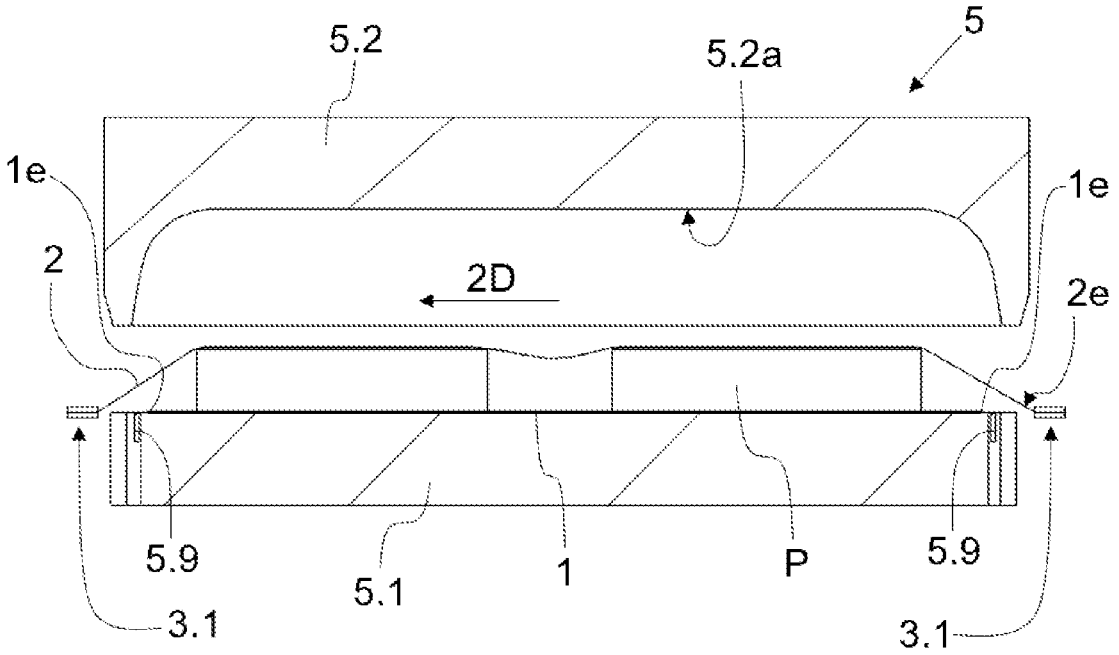
FIG. 2 shows the tools of the joining station of FIG. 1 being open.
Figure 3:
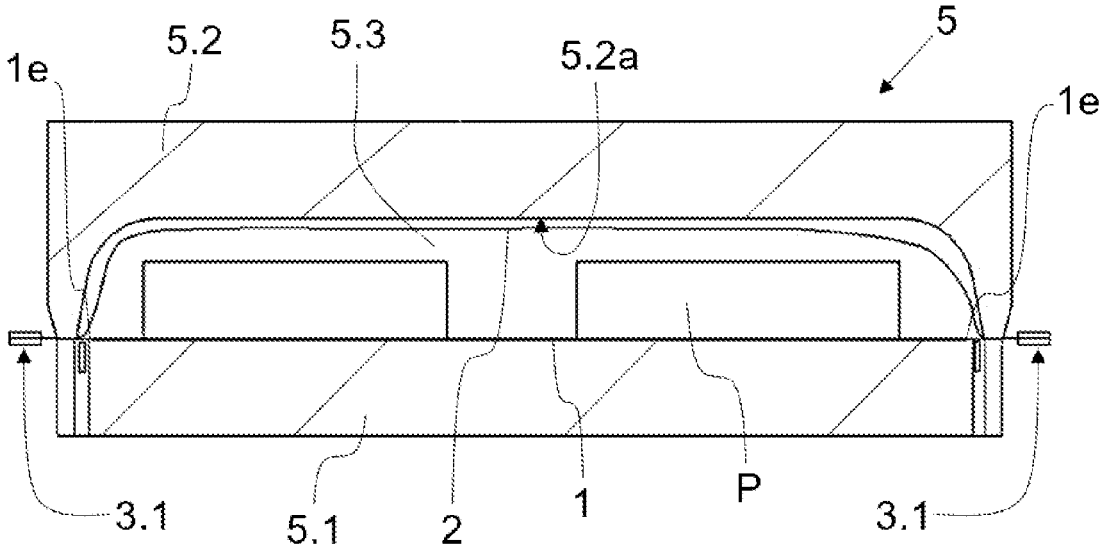
FIG. 3 shows the tools of the joining station of FIG. 1 being closed.
Figure 4:
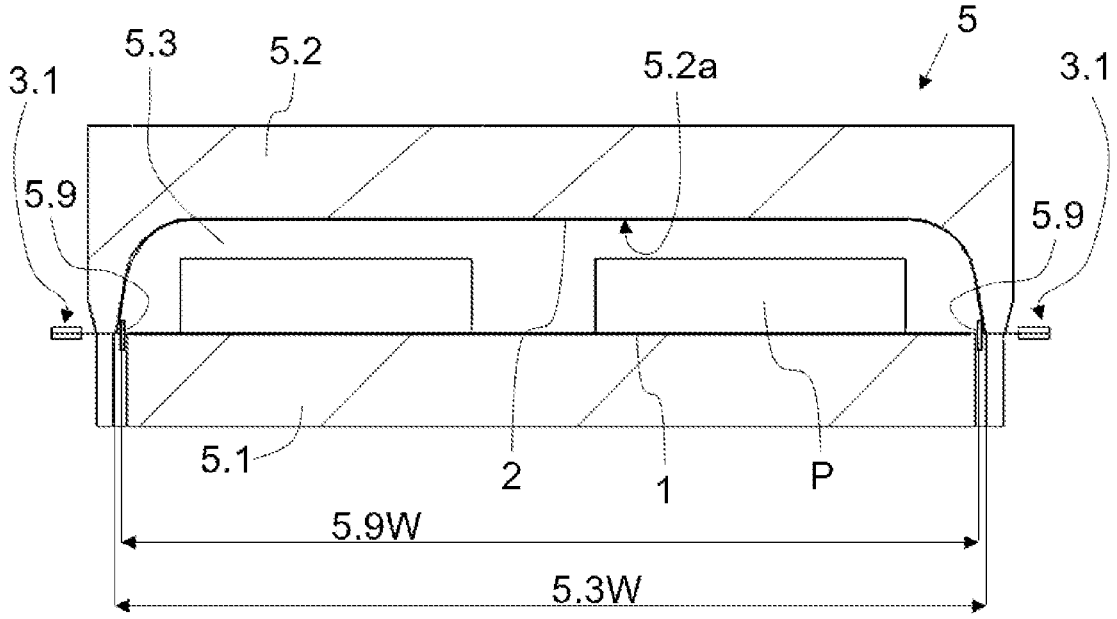
FIG. 4 shows the tools of the joining station of FIG. 1 being closed and with the lifting elements acting on the cover film.

The attachment step is carried out in the joining station 5 which is arranged downstream of the superposing area 7 in the first direction 1D. In said attachment step, both films 1 and 2 are attached to one another with the product P housed between them, the cooperation between a lower tool 5.1 and an upper tool 5.2 of the joining station 5 shown in more detail in FIGS. 2 to 4 being caused to that end. With said cooperation, both tools 5.1 and 5.2 are in contact (closed) and have a shape such that a cavity 5.3 is demarcated between them (FIGS. 3 and 4). Said cavity 5.3 allows housing the product P between both films 1 and 2 in said joining station 2, even while the tools 5.1 and 5.2 are closed. The cavity 5.3 is demarcated at least by two longitudinal walls in the first direction 1D and two transverse walls. In the embodiment shown in the drawings, a plurality of products P can be packaged simultaneously, in this particular case, two products P arranged in parallel in the second direction 2D.

In the second forward movement step, the films 1 and 2 already attached to one another, and with the product P (or products P) therebetween, are moved in the first direction 1D to a cutting station 6 of the machine 100 arranged downstream of the joining station 5 in the first direction 1D.

In the cutting step, at least one transverse cut is made in the films 1 and 2 in a second direction 2D which is transverse to the first direction 1D, the individual packages (a product P packaged in each package) thereby being obtained.

The cover film 2 which is arranged on the base film 1 in the first forward movement step comprises a width greater than the width of the base film 1 in the second direction 2D, such that in said first forward movement step a cover film 2 comprising a width greater than the base film 1 is arranged on said base film 1 and the product P to be packaged. Furthermore, said films 1 and 2 are arranged with respect to one another in the superposing area 7 such that two areas 2*e* of the cover film 2 project transversely from respective longitudinal edges 1*e* of the base film 1 in said second direction 2D, as shown in FIG. 2, for example.

In the first forward movement step and in the second forward movement step, a transport device 3 only acts on the two areas 2*e* of the cover film 2 projecting transversely from the base film 1 (one on each side) to cause the forward movement of both films 1 and 2 in the first direction 1D, at least in the areas 2*e* which are between the joining station 5 and the cutting station 6. Both films 1 and 2 are attached to one another in the joining station 5, so actuation on the cover film 2 in an area downstream of said joining station 5 (at least between the joining station 5 and the cutting station 6) causes the joint movement of both films 1 and 2 in the first direction 1D. Furthermore, this movement is achieved without contact with the base film 1, the discarding of the base film 1 not being necessary, at least as a result of the movement thereof. The actuation of a transport device 3 on a film can cause the film to deteriorate in the areas in contact with said device, and/or the deterioration of said areas must occur to allow said actuation, so by preventing this actuation on the base film 1 this deterioration in same is prevented.

In the attachment step, the tools 5.1 and 5.2 of the joining station 5 cooperate with one another to attach the base film 1 and the cover film 2 to one another, and said cooperation is caused such that the tools longitudinally grip between them said cover film 2 but not said base film 1. In particular, at least parts of the areas 2*e* of the cover film 2 projecting from the respective longitudinal edges 1*e* of the base film 1 are gripped. Actuation on the base film 1 is again prevented, so the need to discard the base film 1 as a result of the attachment between both films 1 and 2 is also prevented. The amount of base film 1 to be used for each end package can therefore be reduced to a minimum, which allows reducing the cost of said package and material wastage.

In the attachment step, gas between said films 1 and 2 is furthermore injected and/or extracted through at least one of the respective access spaces that is available between each longitudinal edge 1*e* of the base film 1 and the longitudinal wall demarcating the cavity 5.3 closer to said longitudinal edge 1*e*. In this manner, in addition to savings with respect to base film 1, the difference in widths is utilized to enable performing additional actuations for generating packages, where packages of different types can be obtained as needed (packaged under modified atmosphere, vacuum packaged or skin packaged for example).

Figure 5:
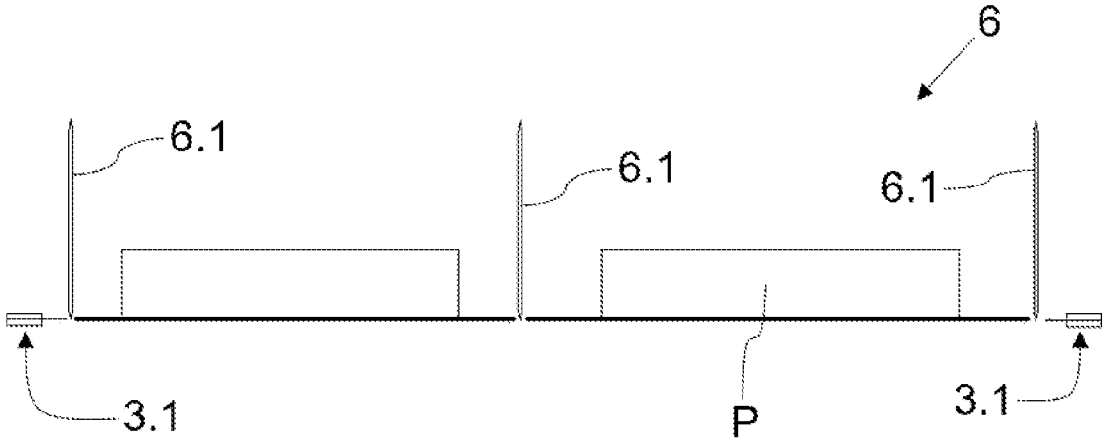
FIG. 5 shows the actuation of the longitudinal cutting tools of the cutting station of the machine of FIG. 1.

In the cutting step, a longitudinal cut is furthermore made in the areas 2*e* of the cover film 2 projecting transversely from the base film 1 by means of respective longitudinal cutting elements 6.1 shown in FIG. 5 to enable discarding them since they have been previously actuated both in the attachment step and in the forward movement steps and may present signs of deterioration, acting on the base film 1 (which is not necessary as it has not been previously actuated) again being prevented. In the case of having a plurality of products P in parallel in the second direction 2D, as depicted in the drawings, an additional longitudinal cut is made with an additional longitudinal cutting element 6.1 between both products P. In this last case, the base film 1 is indeed acted on, but only for separating the different packages from one another, and not on an area of said base film 1 which must be discarded.

To skin package the products, in the joining station 5, during the attachment step the cover film 2 is suctioned towards the surface 5.2*a* which is heated and participates in demarcating the cavity 5.3 (on the upper part), the base film 1 is suctioned towards the lower tool 5.1 (FIGS. 3 and 4), the gas present in said cavity 5.3 is extracted from the lower tool 5.1 and through at least one of the access spaces, and the hot cover film 2 is then pressed on the base film 1 so that it adapts to the contour of the product P and to the base film 1 not covered by the product P.

In some embodiments of the method for skin packaging in which the products are skin packaged, to cause the cooperation between the tools 5.1 and 5.2 of the joining station 5 during the attachment step, the upper tool 5.2 is caused to move towards the lower tool 5.1 while said lower tool 5.1 remains stationary, said upper tool 5.2 being caused to move in the opposite direction to separate the upper tool 5.2 from the lower tool 5.1. In these embodiments, the upper surface of the lower tool 5.1 is planar, the cavity 5.3 comprising a shape demarcated by a surface 5.2*a* of the upper tool 5.2 (such as the case of FIGS. 3 and 4, for example).

Furthermore, in the embodiments of the method whereby skin packages are generated, during the attachment step, the areas 2*e* of the cover film 2 projecting transversely from the base film 1 are acted on, pushing them towards the upper tool 5.2 by means of a respective lifting element 5.9 for each of said areas 2*e*, such that the separation between both films 1 and 2 is made to facilitate the injection and/or extraction of gas between both films 1 and 2.

Preferably, said lifting elements 5.9 are attached with freedom of movement with respect to the lower tool 5.1, and said lifting elements 5.9 are caused to move with respect to said lower tool 5.1 (FIGS. 3 and 4), towards the upper tool 5.2 (towards the surface 5.2*a* of said upper tool 5.2), to cause said pushing. The actuation of the lifting elements 5.9 on the cover film 2 additionally causes the stretching of said cover film 2, and therefore reduces the risk of creases being generated on the base film 1 during the generation of the end package.

In some embodiments, the second forward movement step, a supporting device 8.1 keeps the films 1 and 2 gripped in the movement thereof in the first direction 1D, acting on said films 1 and 2 between the joining station 5 and the cutting station 6, supporting or accompanying said films 1 and 2 during said movement between said joining station 5 and said cutting station 6. This prevents the cover film 2, due to the weight of the product P, for example, from being able to detach from the base film 1 which is only held and moved as a result of being sealed to the cover film 2, affecting the end package which would have to be discarded. With this support or accompaniment of the supporting device 8.1, said product P and said attached films 1 and 2 are kept in place. To that end, the supporting device 8.1 is caused to move in the first direction 1D, synchronized with the movement of the films 1 and 2 and at the same speed, from a first position in which it starts to support or accompany the films 1 and 2, which is preferably at the outlet of the joining station 5 in the first direction 1D, to a second position, which is preferably at the inlet of the cutting station 6 in the first direction 1D, both positions being spaced apart from one another in the first direction 1D. In the second position, the supporting device 8.1 no longer acts on the films 1 and 2, and it is caused to move to the first position in the direction opposite the first direction 1D without contacting the films 1 and 2 (the supporting device 8.1 releases the films 1 and 2 when it reaches the second position). Said release and said return are preferably performed with the films 1 and 2 being stationary (without moving forward in the first direction 1D).

Preferably, the films 1 and 2 are gripped together by a holding device 8.2 arranged between the joining station 5 and the cutting station 6, preferably at the outlet of the joining station 5 from the moment the supporting device 8.1 releases said films 1 and 2 and until the subsequent forward movement of the films 1 and 2 in the first direction 1D. The holding device 8.2 does not move in the first direction 1D, but rather holds the films 1 and 2 when the supporting device 8.1 does not act against same, keeping them stationary and in place, thereby preventing the cover film 2 from being able to detach from the base film 1 due to the weight of the product P.

A second aspect of the invention relates to a product packaging machine 100 such as the one shown by way of example in FIG. 1, which machine comprises:

- a first film feeding device 9.1 which is configured for supplying a base film 1;
- a second film feeding device 9.2 configured for supplying a cover film 2;
- a transport device 3 which is configured for moving the films 1 and 2 in the first direction 1D;
- a superposing area 7;
- a joining station 5 which is downstream of the superposing area 7 in the first direction 1D and comprises a lower tool 5.1 and an upper tool 5.2 which are configured for cooperating with one another to attached both films 1 and 2 to one another and demarcate a cavity 5.3 with said cooperation, for housing the product P and the films 1 and 2 between both tools 5.1 and 5.2, the contour of said cavity 5.3 being demarcated by at least two longitudinal walls in the first direction 1D and two transverse walls and said cavity 5.3 comprising a specific width 5.3W in a second direction 2D which is transverse to the first direction 1D; and a cutting station 6 which is arranged downstream of the joining station 5 in the first direction 1D and configured for cutting the films 1 and 2 and for generating individual packages with said cut.

The transport device 3 is configured for acting only on the cover film 2 and at least between the joining station 5 and the cutting station 6 for moving the films 1 and 2 in the first direction 1D with said actuation. The transport device 3 may comprise two transport tools 3.1 (two chains, for example) extending in the first direction 1D and separated from one another in the second direction 2D, each transport tool 3.1 being configured for acting on a longitudinal area of the cover film 2. Like in the method, the transport device 3 only acts on the cover film 2, without contacting the base film 1, given that it acts on areas 2*e* of said cover film 2 projecting laterally from both longitudinal ends 1*e* of the base film 1 (see FIGS. 2 to 4).

The tools 5.1 and 5.2 of the joining station 5 are configured for cooperating with one another such that, together, they longitudinally grip said cover film 2 but not said base film 1 (see FIGS. 3 and 4), gripping between them at least part of the areas 2*e* projecting laterally from both longitudinal ends 1*e* of the base film 1 along a closed contour, such that it demarcates a leak-tight area. Furthermore, the joining station 5 comprises actuation means (not depicted in the drawings) which are configured for injecting and/or extracting gas between said films 1 and 2.

The cutting station 6 comprises at least one longitudinal cutting element 6.1 suitable for longitudinally cutting only the cover film 2, preferably two longitudinal cutting elements 6.1 facing one another in the second direction 2D and configured for acting on a respective area 2*e* of the cover film 2. In the case of there being a plurality of products P in parallel in the second direction 2D, as depicted in the drawings, an additional longitudinal cut is made with an additional longitudinal cutting element 6.1 between both products P as shown in FIG. 5. In this last case, the base film 1 is indeed acted on, but only for separating the different packages from one another, and not on an area of said base film 1 which must be discarded.

The films 1 and 2 move forward in the first direction 1D, being superimposed and located between the tools 5.1 and 5.2 of the joining station 5. Said tools 5.1 and 5.2 are facing one another and configured for being arranged in a first position in which they are separated and allow the forward movement of the films 1 and 2, and in a second position in which they cooperate with one another to attach the films 1 and 2 arranged between them to one another, gripping said films 1 and 2 together to keep them stationary. In some embodiments, the lower tool 5.1 remains stationary at all times, with the upper tool 5.2 being configured for being moved with respect to the lower tool 5.1 to cause a change in position of said tools 5.1 and 5.2. In these embodiments, the lower tool 5.1 preferably comprises a planar surface, facing the upper tool 5.2, over which the films 1 and 2 are moved, the shape of the cavity 5.3 depending on the surface 5.2*a* of the upper tool 5.2. These embodiments are particularly advantageous when the tray of the end package is planar (tray formed by the base film 1 present in the end package), where formation of the base film 1 and use of the machine 100, therefore of a forming station to perform said forming, are not required.

In some embodiments, the machine 100 comprises two longitudinal lifting elements 5.9 facing one another in the second direction 2D and separated from one another by a separating distance 5.9W in said second direction 2D.

Said lifting elements 5.9 are preferably attached to the lower tool 5.1, with freedom of movement towards the upper tool 5.2, for pushing the film 2 arranged on said lifting elements 5.9 towards said upper tool 5.2. Preferably, the lifting elements 5.9 are at the same level as, or at a lower level than, the planar surface of the lower tool 5.1 in a standby position, such that it does not affect the movement of the films 1 and 2 in the first direction 1D. Said lifting elements 5.9 are configured for being moved simultaneously, and once the tools 5.1 and 5.2 are cooperating with one another, such that they move the cover film 2 closer to the surface 5.2*a* of the upper tool 5.2. That is possible due to the difference in widths between both films 1 and 2 that has been described above, the separating distance 5.9W between both lifting elements 5.9 being such that they act on the areas 2*e* of the cover film 2 projecting laterally from the base film 1. The machine 100 comprises a control device which is configured for causing this movement of the lifting elements 5.9 in the embodiments of the machine 100 comprising such lifting elements 5.9.

The cavity 5.3 demarcated between both tools 5.1 and 5.2 of the joining station 5 comprises a width 5.3W in the second direction 2D greater than the separating distance 5.9W between the two lifting elements 5.9, said lifting elements 5.9 being centered with respect to said cavity 5.3 in said second direction 2D. This enables pushing the cover film towards the surface 5.2*a* of the upper tool 5.2.

In some embodiments, the machine 100 comprises a supporting device 8.1 like the one described for the first aspect of the invention, which keeps the films 1 and 2 gripped in the movement thereof in the first direction 1D, acting on said films 1 and 2 between the joining station 5 and the cutting station 6, supporting or accompanying said films 1 and 2 during said movement between said joining station 5 and said cutting station 6. This prevents the cover film 2, due to the weight of the product P, for example, from being able to detach from the base film 1 which is only held and moved as a result of being sealed to the cover film 2, affecting the end package which would have to be discarded. With this support or accompaniment of the supporting device 8.1, said product P and said attached films 1 and 2 are kept in place. To that end, the supporting device 8.1 is caused to move in the first direction 1D, synchronized with the movement of the films 1 and 2 and at the same speed, from a first position in which it starts to support or accompany the films 1 and 2, which is preferably at the outlet of the joining station 5 in the first direction 1D, to a second position, which is preferably at the inlet of the cutting station 6 in the first direction 1D, both positions being spaced apart from one another in the first direction 1D. In the second position, the supporting device 8.1 no longer acts on the films 1 and 2, and it is caused to move to the first position in the direction opposite the first direction 1D without contacting the films 1 and 2 (the supporting device 8.1 releases the films 1 and 2 when it reaches the second position). Said release and said return are preferably performed with the films 1 and 2 being stationary (without moving forward in the first direction 1D).

The supporting device 8.1 is arranged downstream of the joining station 5 in the first direction 1D, and between the two transport tools 3.1 of the transport device 3 with respect to the second direction 2D. The supporting device 8.1 preferably comprises a first hold-down plate and a second hold-down plate facing one another and arranged such that the films 1 and 2 are between both hold-down plates. In other words, said hold-down plates are arranged such that one of them is above and the other below a horizontal plane X of the machine 100, which corresponds with the plane of the superimposed films 1 and 2. Both hold-down plates are facing one another, and at least one of them is configured for being able to be moved towards the other and in the opposite direction, to grip the films 1 and 2 between them and release same, respectively. Both hold-down plates are configured for being moved simultaneously in the first direction 1D and in the opposite direction, and the control device is configured for causing the movement of said hold-down plates in the first direction 1D synchronized with the movement in said first direction 1D of the transport device 3 (and of the films 1 and 2), as described for the first aspect of the invention.

In the embodiments of the machine 100 comprising a supporting device 8.1, the control device is configured for causing the hold-down plates of the supporting device 8.1 to move synchronously with the films 1, 2 in the first direction 1D.

In some embodiments, the machine 100 comprises a holding device 8.2 like the one described for the first aspect of the invention. The holding device 8.2 is arranged downstream of the joining station 5 in the first direction 1D and between the two transport tools 3.1 of the transport device 3 with respect to the second direction 2D, preferably at the outlet of the joining station 5 in the first direction 1D. The holding device 8.2 comprises a first hold-down plate below the horizontal plane X of the machine 100 and a second hold-down plate facing the first hold-down plate and arranged above said horizontal plane X, at least one of said hold-down plates being configured for being moved towards the other corresponding hold-down plate and in the opposite direction and said hold-down plates being immobilized in the first direction 1D and in the direction opposite said first direction 1D (i.e., they are moved neither in said first direction 1D nor in the opposite direction), as described for the first aspect of the invention. Therefore, the holding device 8.2 holds the films 1 and 2 when the supporting device 8.1 does not act against same, keeping them stationary and in place, thereby preventing the cover film 2 from being able to detach from the base film 1 due to the weight of the product P.

In the embodiments of the machine 100 comprising a holding device 8.2, the control device is configured for causing the hold-down plates of the holding device 8.2 to hold the films 1 and 2 when the transport device 3 does not move the films 1 and 2 in the first direction 1D, and to not hold said films 1 and 2 when the transport device 3 is moving said films 1 and 2 in the first direction 1D.

Generally, all that has been described for the method, in any of its embodiments and/or configurations, is also valid for the embodiments and/or configurations of the machine 100. The machine 100 therefore comprises the embodiment and/or configuration suitable for supporting the corresponding embodiment and/or configuration of the method.

Similarly, all that has been described for the machine 100, in any of its embodiments and/or configurations, is also valid for the embodiments and/or configurations of the method. The method therefore comprises the embodiment and/or configuration suitable for the corresponding embodiment and/or configuration of the machine 100.

Embodiments of the invention are also disclosed in the following clauses.

Clause 1. Method for modified atmosphere, vacuum or skin packaging of food products in a thermoforming machine, the method, for generating a package, comprising:

a first forward movement step in which a cover film (2) is arranged on a product (P) to be packaged and on a base film (1) which supports said product (P), in a superposing area (7) of the machine (100), and in which both films (1, 2) are moved in a first direction (1D) to a joining station (5) of the machine (100) which is arranged downstream of the superposing area (7) in the first direction (1D);

an attachment step in which both films (1, 2) are attached to one another with the product (P) housed between them, the cooperation between a lower tool (5.1) and an upper tool (5.2) of the joining station (5) being caused to that end, with a cavity (5.3) around the product (P) being demarcated between both tools (5.1, 5.2) through said cooperation and the contour of said cavity (5.3) being demarcated by two longitudinal walls and two transverse walls;

a second forward movement step in which the films (1, 2) attached in the joining station (5) are moved in the first direction (1D) to a cutting station (6) of the machine (100) arranged downstream of the joining station (5) in the first direction (1D); and a cutting step in which at least one transverse cut is made in the films (1, 2) in a second direction (2D) which is transverse to the first direction (1D), obtaining an individual package with the product (P) therein;

the cover film (2) which is arranged on the base film (1) in the first forward movement step comprises a width greater than the width of the base film (1) in the second direction (2D), said films (1, 2) being arranged with respect to one another in the superposing area (7) such that two areas (2*e*) of the cover film (2) project transversely from respective longitudinal edges (1*e*) of the base film (1) in said second direction (2D), in the first forward movement step and in the second forward movement step a transport device (3) only acts on the two areas (2*e*) of the cover film (2) projecting transversely from the base film (1) to cause the forward movement of both films (1, 2) in the first direction (1D), at least between the joining station (5) and the cutting station (6), in that in the attachment step the tools (5.1, 5.2) of the joining station (5) cooperate with one another to attach the base film (1) and the cover film (2) to one another such that they longitudinally grip said cover film (2) but not said base film (1), and gas between said films (1, 2) is injected and/or extracted through at least one of the respective access spaces that is available between each longitudinal edge (1*e*) of the cover film (1) and the longitudinal wall demarcating the cavity (5.3) closer to said longitudinal edge (1*e*), and in that in the cutting step a longitudinal cut is made on the areas (2*e*) of the cover film (2) projecting transversely from the base film (1).

Clause 2. Method according to clause 1, wherein in the joining station (5), during the attachment step the cover film (2) is suctioned towards a heated surface (5.2*a*) of the upper tool (5.2) participating in demarcating the cavity (5.3) generated inside the joining station (5), the base film (1) is suctioned towards the lower tool (5.1), the gas present in said cavity (5.3) is extracted from the lower tool (5.1) and through at least one of the access spaces, and the hot cover film (2) is then pressed on the base film (1).

Clause 3. Method according to any of clauses 1 to 2, wherein to cause the cooperation between both tools (5.1, 5.2) of the joining station (5) during the attachment step, the upper tool (5.2) is caused to move towards the lower tool (5.1) while said lower tool (5.1) remains stationary, said upper tool (5.2) being caused to move in the opposite direction to separate the upper tool (5.2) from the lower tool (5.1).

Clause 4. Method according to clause 3, wherein with the tools (5.1, 5.2) of the joining station (5) cooperating with one another, and during the attachment step, the areas (2*e*) of the cover film (2) projecting transversely from the base film (1) are acted on, pushing them towards the upper tool (5.2) by means of a respective lifting element (5.9) for each of said areas (2*e*), said lifting elements (5.9) being caused to move with respect to the lower tool (5.1) to cause said pushing, from said lower tool (5.1) of the joining station (5) towards the upper tool (5.2) of said joining station (5).

Clause 5. Method according to any of clauses 1 to 4, wherein during the second forward movement step, a supporting device (8.1) keeps the films (1, 2) gripped between the joining station (5) and the cutting station (6), during the forward movement thereof, the supporting device (8.1) being caused to move in the first direction (1D) from a first position to a second position that are spaced apart in the first direction (1D), together and simultaneously with the forward movement of the films (1, 2).

Clause 6. Method according to clause 7, wherein the supporting device (8.1) releases the films (1, 2) after reaching the second position and the return of the supporting device to the first position is caused by moving it in the direction opposite the first direction (1D), said release and said return preferably being performed with the films (1, 2) being stationary without moving forward in the first direction (1D).

Clause 7. Method according to clause 5 or 6, wherein the films (1, 2) are gripped together by a holding device (8.2) arranged between the joining station (5) and the cutting station (6) from the moment the supporting device (8.1) releases said films (1, 2) and until the subsequent forward movement of the films (1, 2) in the first direction (1D).

Clause 8. Modified atmosphere, vacuum or skin product packaging thermoforming machine comprising

- a first film feeding device (9.1) which is configured for supplying a base film (1);
- a second film feeding device (9.2) configured for supplying a cover film (2);
- a transport device (3) which is configured for moving the films (1, 2) in a first direction (1D);
- a superposing area (7);
- a joining station (5) which is downstream of the superposing area (7) in the first direction (1D) and comprises a lower tool (5.1) and an upper tool (5.2) which are configured for attaching both films (1, 2) to one another with the cooperation thereof and demarcate a cavity (5.3) with said cooperation, for housing the product (P) and the films (1, 2) between both tools (5.1, 5.2), the contour of said cavity (5.3) being demarcated at least by two longitudinal walls in the first direction (1D) and two transverse walls and said cavity (5.3) comprising a specific width (5.3W) in a second direction (2D) which is transverse to the first direction (1D); and
- a cutting station (6) which is arranged downstream of the joining station (5) in the first direction (1D) and configured for cutting the films (1, 2) and for generating individual packages with said cut;
- the transport device (3) is configured for acting only on the cover film (2) and at least between the joining station (5) and the cutting station (6) for moving the films (1, 2) in the first direction (1D) with said actuation, the tools (5.1, 5.2) of the joining station (5) being configured for cooperating with one another such that, together, they longitudinally grip said cover film (2) but not said base film (1), the machine (100) comprising actuation means in the joining station (5) which are configured for injecting and/or extracting gas between said films (1, 2), and the cutting station (6) comprising at least one longitudinal cutting element (CL) suitable for longitudinally cutting only the cover film (2).

Clause 9. Machine according to clause 8, wherein the tools (5.1, 5.2) of the joining station (5) are facing one another and configured for being arranged in a first position in which they are separated and in a second position in which they cooperate with one another to attach the films (1, 2) arranged between them to one another, the lower tool (5.1) being stationary and the upper tool (5.2) being configured for being moved with respect to the lower tool (5.1) to change the position of said tools (5.1, 5.2).

Clause 10. Machine according to clause 9, comprising two longitudinal lifting elements (5.9) arranged facing one another in the second direction (2D) and separated from one another by a separating distance (5.9) in said second direction (2D), said lifting elements (5.9) being attached to the lower tool (5.1) with freedom of movement towards the upper tool (5.2) for pushing the cover film (2) arranged on said lifting elements (5.9) towards said upper tool (5.2).

Clause 11. Machine according to clause 10, wherein the cavity (5.3) demarcated between both tools (5.1, 5.2) of the joining station (5) comprises a width (5.3W) in the second direction (2D) greater than the separating distance (5.9W) between the two lifting elements (5.9), said lifting elements (5.9) being centered with respect to said cavity (5.3) in said second direction (2D).

Clause 12. Machine according to any of clauses 8 to 11, wherein the transport device (3) comprises two transport tools (3.1) facing one another in the second direction (2D), the machine (100) comprising at least one supporting device (8.1) arranged downstream of the joining station (5) in the first direction (1D) and between said transport tools (3.1) with respect to the second direction (2D), the supporting device (8.1) comprising a first hold-down plate below a horizontal plane (X) of the machine (100), which corresponds with the plane of the films (1, 2), and a second hold-down plate facing the first hold-down plate arranged above said horizontal plane (X) of the machine (100), at least one of said hold-down plates being configured for being moved towards the other hold-down plate and in the opposite direction, and both hold-down plates being suitable for being moved in the first direction (1D) and in the opposite direction together and simultaneously.

Clause 13. Machine according to clause 12, comprising a control device configured for causing the hold-down plates of the supporting device (8.1) to move synchronously with the films (1, 2) in the first direction (1D).

Clause 14. Machine according to clause 12 or 13, comprising a holding device (8.2) arranged downstream of the joining station (5) in the first direction (1D), and between the two transport tools (3.1) of the transport device (3) with respect to the second direction (2D), the holding device (8.2) comprising a first hold-down plate below the horizontal plane (X) of the machine (100) and a second hold-down plate facing the first hold-down plate and arranged above said horizontal plane (X), at least one of said hold-down plates being configured for being moved towards the other corresponding hold-down plate and in the opposite direction and said hold-down plates being immobilized in the first direction (1D) and in the direction opposite said first direction (1D).

Clause 15. Machine according to clause 13 or 14, wherein the control device is configured for causing the hold-down plates of the holding device (8.2) to hold the films (1, 2) when the transport device (3) does not move the films (1, 2) in the first direction (1D), and to not hold said films (1, 2) when the transport device (3) is moving said films (1, 2) in the first direction (1D).

What is claimed is:

1. A method of generating a food package in a thermoforming machine, the method comprising:

arranging a product so that the product is supported on a base film and covered with a cover film in a superposing area of the thermoforming machine, each of the cover film and base film having a width, the width being transverse to a forward movement direction of the base and cover films, the width of the cover film being greater than the width of the base film, the base film having first and second longitudinal edges, the cover film having first and second areas that respectively project transversely from the first and second longitudinal edges;

moving the base film and cover film in the forward movement direction to a joining station of the thermoforming machine, the joining station being located downstream the superposing area and including a lower tool and an upper tool, the base film and cover film being moved to the joining station by a transport device, the transport device acting on the cover film only on the first and second areas;

one or both of the upper and lower tools of the joining station demarcating a cavity in which the product resides during an attaching of the base and cover films, injecting and/or extracting a gas located between the base and cover films, attaching the base film and cover film with the product housed between them with the use of the lower and upper tools of the joining station, the upper and lower tools gripping, longitudinally, the cover film and not the base film;

moving the attached base and cover films with the product disposed between them in the forward movement direction from the joining station to a cutting station of the thermoforming machine, the base film and cover film being moved to the cutting station by the transport device that acts only on the first and second areas of the cover film; and gripping both the base film and the cover film by use of a supporting device while the base film and cover film are moved to the cutting station, the supporting device being caused to move in the forward movement direction from a first position to a second position simultaneously with the cover and base films being moved by the transport device to the cutting station, wherein when the base film and cover film are located in the joining station, the first and second areas of the cover film projecting transversely from the base film are respectively acted on by first and second lifting elements to cause the first and second areas to be pushed towards the upper tool.

2. The method of generating a food package according to claim 1, further comprising cutting at least the cover film to obtain the food package with the food located therein, the cut being transverse to the forward movement direction, and longitudinally cutting the first and second areas of the cover film that project transversely from the base film.

3. The method of generating a food package according to claim 1, wherein the supporting device ceases gripping the base film and the cover film after the supporting device reaches the second position and thereafter returns to the first position.

4. The method of generating a food package according to claim 3, wherein the base film and cover film are stationary when the supporting device ceases gripping the base film and while the supporting device returns to the first position.

5. The method of generating a food package according to claim 3, wherein the thermoforming machine includes a holding device located between the joining station and the supporting device, the base film and cover film being gripped together by the holding device from the moment the supporting device ceases gripping the base and cover films and until a subsequent movement of the base film and cover film in the forward movement direction.

6. The method of generating a food package according to claim 1, wherein each of the first and second lifting elements protrude from the lower tool towards the upper tool at least when the first and second lifting elements cause the first and second areas to be pushed towards the upper tool.

7. The method of generating a food package according to claim 1, wherein each of the first and second lifting elements are joined to the lower tool with freedom of movement and are caused to move with respect to the lower tool, towards the upper tool, to cause the first and second areas to be pushed towards the upper tool.

8. The method of generating a food package according to claim 1, wherein the first and second lifting elements are caused to move with respect to the lower tool, towards the upper tool, when the lower tool is in contact with the upper tool.

9. A method of generating a food package in a thermoforming machine, the method comprising:

arranging a product so that the product is supported on a base film and covered with a cover film in a superposing area of the thermoforming machine, each of the cover film and base film having a width, the width being transverse to a forward movement direction of the base and cover films, the width of the cover film being greater than the width of the base film, the base film having first and second longitudinal edges, the cover film having first and second areas that respectively project transversely from the first and second longitudinal edges;

moving the base film and cover film in the forward movement direction to a joining station of the thermoforming machine, the joining station being located downstream the superposing area and including a lower tool and an upper tool, the base film and cover film being moved to the joining station by a transport device, the transport device acting on the cover film only on the first and second areas;

one or both of the upper and lower tools of the joining station demarcating a cavity in which the product resides during an attaching of the base and cover films, injecting and/or extracting a gas located between the base and cover films, attaching the base film and cover film with the product housed between them with use of the lower and upper tools of the joining station, the upper and lower tools gripping, longitudinally, the cover film and not the base film;

moving the attached base and cover films with the product disposed between them in the forward movement direction from the joining station to a cutting station of the thermoforming machine, the base film and cover film being moved to the cutting station by the transport device that acts only on the first and second areas of the cover film; and gripping both the base film and the cover film by use of a supporting device while the base film and cover film are moved to the cutting station, the supporting device being caused to move in the forward movement direction from a first position to a second position simultaneously with the cover and base films being moved by the transport device to the cutting station, wherein the supporting device ceases gripping the base film and the cover film after the supporting device reaches the second position and thereafter returns to the first position, wherein the base film and cover film are stationary when the supporting device ceases gripping the base film and while the supporting device returns to the first position, wherein the thermoforming machine includes a holding device located between the joining station and the supporting device, the base film and cover film being gripped together by the holding device from the moment the supporting device ceases gripping the base and cover films and until a subsequent movement of the base film and cover film in the forward movement direction.

10. The method of generating a food package according to claim 9, wherein the base film and cover film are stationary when the supporting device ceases gripping the base film and while the supporting device returns to the first position.

* * * * *